US008839756B2

(12) United States Patent
Ozaki et al.

(10) Patent No.: US 8,839,756 B2
(45) Date of Patent: Sep. 23, 2014

(54) INTAKE AIR ROUTING DEVICE FOR AN ENGINE, AND ENGINE INCORPORATING SAME

(71) Applicant: Honda Motor Co., Ltd., Tokyo (JP)

(72) Inventors: Yoshinobu Ozaki, Saitama (JP); Akihiko Hamazaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 50 days.

(21) Appl. No.: 13/768,452

(22) Filed: Feb. 15, 2013

(65) Prior Publication Data

US 2013/0220259 A1 Aug. 29, 2013

(30) Foreign Application Priority Data

Feb. 29, 2012 (JP) ..... 2012-044348
Sep. 20, 2012 (JP) ..... 2012-207368

(51) Int. Cl.
*F02M 35/10* (2006.01)
*F02M 35/024* (2006.01)
*F02M 35/16* (2006.01)

(52) U.S. Cl.
CPC ... *F02M 35/10091* (2013.01); *F02M 35/02416* (2013.01); *F02M 35/162* (2013.01); *F02M 35/10039* (2013.01)
USPC ..... 123/184.53; 180/68.1; 55/385.3

(58) Field of Classification Search
USPC ..... 123/184.21, 184.53, 198 E; 180/68.1, 180/68.3; 55/385.3
See application file for complete search history.

(56) References Cited

FOREIGN PATENT DOCUMENTS

JP 01-208559 A 8/1989

*Primary Examiner* — Noah Kamen
(74) *Attorney, Agent, or Firm* — Carrier Blackman & Associates, P.C.; Joseph P. Carrier; William D. Blackman

(57) ABSTRACT

An intake air routing device for an engine having a plurality of cylinders, includes a pair of half case bodies forming an air chamber, an air filter arranged in the air chamber and configured to purify outside air received via an intake duct, and a plurality of intake passages extending from the air chamber. The plurality of intake passages are connected with respective intakes ports of the engine. A partition plate is disposed in the air chamber, and is formed separately from the case bodies. The partition plate is arranged in the air chamber such that it extends in the air chamber by a predetermined length in a direction intersecting with a direction where the intake passages are lined up so as to partition the intake passages from each other. Such intake air routing device reduces intake interference while maintaining a small size of the intake air routing device.

20 Claims, 14 Drawing Sheets

EMBODIMENT

COMPARATIVE EXAMPLE

INTAKE AIR ROUTING DEVICE FOR AN ENGINE, AND ENGINE INCORPORATING SAME

CROSS-REFERENCE TO RELATED APPLICATIONS

The present invention claims priority under 35 USC 119 based on Japanese patent applications Nos. 2012-207368, filed on Sep. 20, 2012, and 2012-044348, filed on Feb. 29, 2012. The entire subject matter of these priority documents, including specification claims and drawings thereof, is incorporated by reference herein.

BACKGROUND OF THE INVENTION

1. Field of the Invention

The present invention relates to an intake air routing device having a plurality of intake passages and a partition wall for partitioning intake passages from each other, and to an engine incorporating the same. More particularly, the present invention relates to an intake air routing device having a partition wall extending in an air chamber thereof by a predetermined length beyond upstream ends of the intake passages, and to an engine incorporating the same.

2. Description of the Background Art

There is a known intake air routing device having a plurality of intake passages for supplying intake air to respective cylinders of an internal combustion engine having a plurality of cylinders. An example of such known intake air routing device is disclosed in the Japanese Patent Document JP-A No. 1-208559 (particularly in FIG. 3 thereof).

As shown in FIG. 3 of the Japanese Patent Document JP-A No. 1-208559, an intake air routing device (18) for supplying intake air to an internal combustion engine having two cylinders (parenthesized numbers represent reference signs shown in the Japanese Patent Document JP-A No. 1-208559; some element names were changed and the same applies hereinafter) includes clean chambers (29A, 29B) partitioned from each other by a partition wall (28). The intake air routing device (18) is provided with an air chamber function serving as an air reservoir of the intake air.

In the intake air routing device of the Japanese Patent Document JP-A No. 1-208559, the clean chambers (29A, 29B) are completely partitioned from each other by the partition wall (28). With the clean chambers (29A, 29B) completely partitioned from each other, a phenomenon of mutual influence of intake air (hereinafter, referred to as "intake interference") flowing through intake pipes extending from each of cylinders is eliminated. The phenomenon is caused due to a difference in intake timing between the cylinders.

However, depending on the engine displacement, there is a need to increase capacity of the clean chamber per cylinder in order to secure air volume of respective cylinders. Consequently, there was a possibility of increasing the size of the intake air routing device as a whole.

It is one of the objects of the present invention to provide a technology capable of reducing intake interference while suppressing an enlargement of intake air routing device for supplying intake air to an internal combustion engine having a plurality of cylinders.

SUMMARY OF THE INVENTION

In order to achieve the above objects, the present invention according to a first aspect thereof provides an intake air routing device for supplying air to respective intake ports connected with intake passages of an internal combustion engine. The intake air routing device includes a case body defining an air chamber configured to take in outside air and purify the same through an element (e.g., an air filter), a plurality of intake passages extending from the air chamber, and a partition wall formed separately formed the case body. The partition wall is disposed in the air chamber and extends therein by a predetermined length in a direction intersecting with a direction where intake passages are lined up, so as to partition upstream ends of the intake passages from each other.

According to a second aspect of the present invention, the partition wall extends up to a position beyond the upstream ends of the intake passages.

According to a third aspect of the present invention, the partition wall is made larger than ½ of an inner diameter of the upstream ends of the intake passages beyond the upstream ends of the intake passages.

According to a fourth aspect of the present invention, one end and another end of the partition wall in a direction orthogonal to an extending direction of the partition wall extend up to the vicinity of an inner surface of the air chamber.

According to a fifth aspect of the present invention, one end of the partition wall is arranged close to an inner surface of a ceiling section or a bottom section of the case body forming the air chamber at a predetermined interval, and another end of the partition wall is arranged close to the inner surface of the ceiling section or the bottom section of the air chamber at a predetermined interval.

According to a sixth aspect of the present invention, the upstream ends of the intake passages include a different member removable from the intake passages, and the partition wall is formed integrally with the upstream ends of the intake passages and fitted to the inner surface of the air chamber.

According to a seventh aspect of the present invention, the partition wall is integrally formed on a base member configured to fit the upstream ends of the intake passages into the inner surface of the air chamber.

According to a eighth aspect of the present invention, a fastening boss section is integrally formed on the base member by the partition wall displaced from intake axes of the intake passages to fasten the base member to the air chamber, and the partition wall is continuous so as to bypass around the fastening boss section.

According to a ninth aspect of the present invention, the intake passages are inserted into a vertical wall of the air chamber, a drain chamber is provided below the vertical wall for collecting drain in the air chamber, and a first cutout section where the partition wall is cut out is provided for preventing the partition wall from intruding into the drain chamber, and the upstream ends of the intake passages are bent diagonally upward so that the farther apart from the vertical wall, the higher the upstream ends are positioned.

According to a tenth aspect of the present invention, a second cutout section is provided to the partition wall above the vertical wall, an upper communication section is formed between the second cutout section and the ceiling section of the air chamber in a position near to a connection end with a funnel member connected to an intake port of the internal combustion engine, and a lower communication section is formed between the first cutout section and the bottom section of the air chamber in the position near to the connection end with the funnel member connected to the intake port of the internal combustion engine.

Advantageous Effects of Invention

According to the first aspect of the present invention, the partition wall extends between the upstream ends of the intake passages and extends in a direction intersecting with a direction where the intake passages are lined up. Air entering into the air chamber and purified through the element (e.g., air filter) is partitioned by the partition wall and reaches respective intake passages. This partition wall reduces the so-called intake interference wherein an intake air flowing through an intake passage influences an intake air flowing through another intake passage.

The partition wall is formed separately from the case body and extended into the air chamber by a predetermined length to partition the upstream ends of the intake passages from each other, whereby the intake interference can be reduced and the capacity increase of the air chamber can be suppressed.

Accordingly, the present invention provides an intake air routing device capable of reducing the intake interference and suppressing the enlargement of the intake air routing device.

According to the second aspect of the present invention, the partition wall extends up to a position beyond the upstream end of the intake passage. Since the partition wall extends beyond the upstream end of the intake passages, occurrence of the intake interference wherein an air flowing through one intake passage influences an air flowing through another intake passage can be suppressed.

According to the third aspect of the present invention, the partition wall is made lager than ½ of the inner diameter of the upstream ends of the intake passages beyond the upstream ends of the intake passages. Since the partition wall extends beyond the upstream ends of the intake passages, interference of intake air passing through neighboring intake passages can be sufficiently suppressed by the partition wall. Consequently, the intake interference can be further reduced.

According to the fourth aspect of the present invention, one end and another end of the partition wall extend up to the vicinity of an inner surface of the air chamber. One end and another end of the partition wall extending up to the vicinity of the inner surface of the air chamber prevent an intake air from flowing into a neighboring intake passage by bypassing around an upstream end of an intake passage and thereby reduce intake interference by such a bypassing air.

According to the fifth aspect of the present invention, the one end and the another end of the partition wall are respectively arranged close to the inner surface of the ceiling section and the bottom section forming the air chamber at the predetermined intervals. Intake air is moved to another intake passage through a clearance between the partition wall and the ceiling section and a clearance between the partition wall and the bottom section. Generation of the turbulence of an airflow between the intake passages is suppressed by the clearances, and also the intake air can be distributed to the respective intake passages in a balanced manner. As a result, engine output characteristics are balanced.

According to the sixth aspect of the present invention, upstream ends of the intake passages and the partition wall are formed integrally in a removable manner, so that layout position of the upstream ends and the partition wall in the air chamber can be adjusted easily from outside of the air chamber. In addition, the upstream ends of the intake passages and the partition wall are mounted in the air chamber in a removable manner, whereby assembly working efficiency can be enhanced.

According to the seventh aspect of the present invention, the partition wall is integrally formed on the base member. Since the partition wall is integrally formed on the base member where the upstream ends of the intake passages are mounted, the number of parts can be reduced more than a case where the partition wall and base member are mounted separately from each other.

According to the eighth aspect of the present invention, the partition wall is continuous so as to bypass around the fastening boss section which is integrally formed on the base member. Since the partition wall is arranged continuously by displacing the fastening boss section from an intake axis so as to bypass around the fastening boss section, there is no concern that the fastening boss section hinders flow of the intake air even when the fastening boss section is formed at the middle of the partition wall.

According to the ninth aspect of the present invention, the first cutout section is provided to the partition wall in a drain chamber provided in the air chamber. Since the first cutout section is formed in the partition wall to form a communication space as a drain chamber, a single drain chamber suffices compared with a related art which partitions the entire air chamber while suppressing the intake interference, whereby a structure of the air chamber can be simplified.

Further, the farther apart from the vertical wall, the larger the upstream ends of the intake passages are bent diagonally upward. Since the drain chamber and the upstream ends of the intake passages are disposed at the bottom of the air chamber, there is no concern of adverse effects against the prevention of the intake interference.

According to the tenth aspect of the present invention, the second cutout section is provided to the partition wall above the vertical wall, the upper communication section is formed between the second cutout section and the ceiling section of the air chamber in a position near to a connection end with the funnel member, and the lower communication section is formed between the first cutout section and the bottom section of the air chamber in the position near to the connection end with the funnel member. The intake air is moved to another intake passage through the upper and lower communication sections. Generation of the turbulence of the airflow between the intake passages is suppressed by the upper and lower communication sections, and also the intake air can be distributed to the respective intake passages in the more balanced manner.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Illustrative embodiments of the present invention will now be described in detail, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

In other words, in drawings and the illustrated embodiments, "UP", "DOWN", "FRONT", "REAR", "LEFT", and "RIGHT", respectively represent a direction viewed from a rider of a motorcycle.

First Embodiment

Now, a first illustrative embodiment of the present invention will be described with reference to the accompanying drawings.

Figure 1:
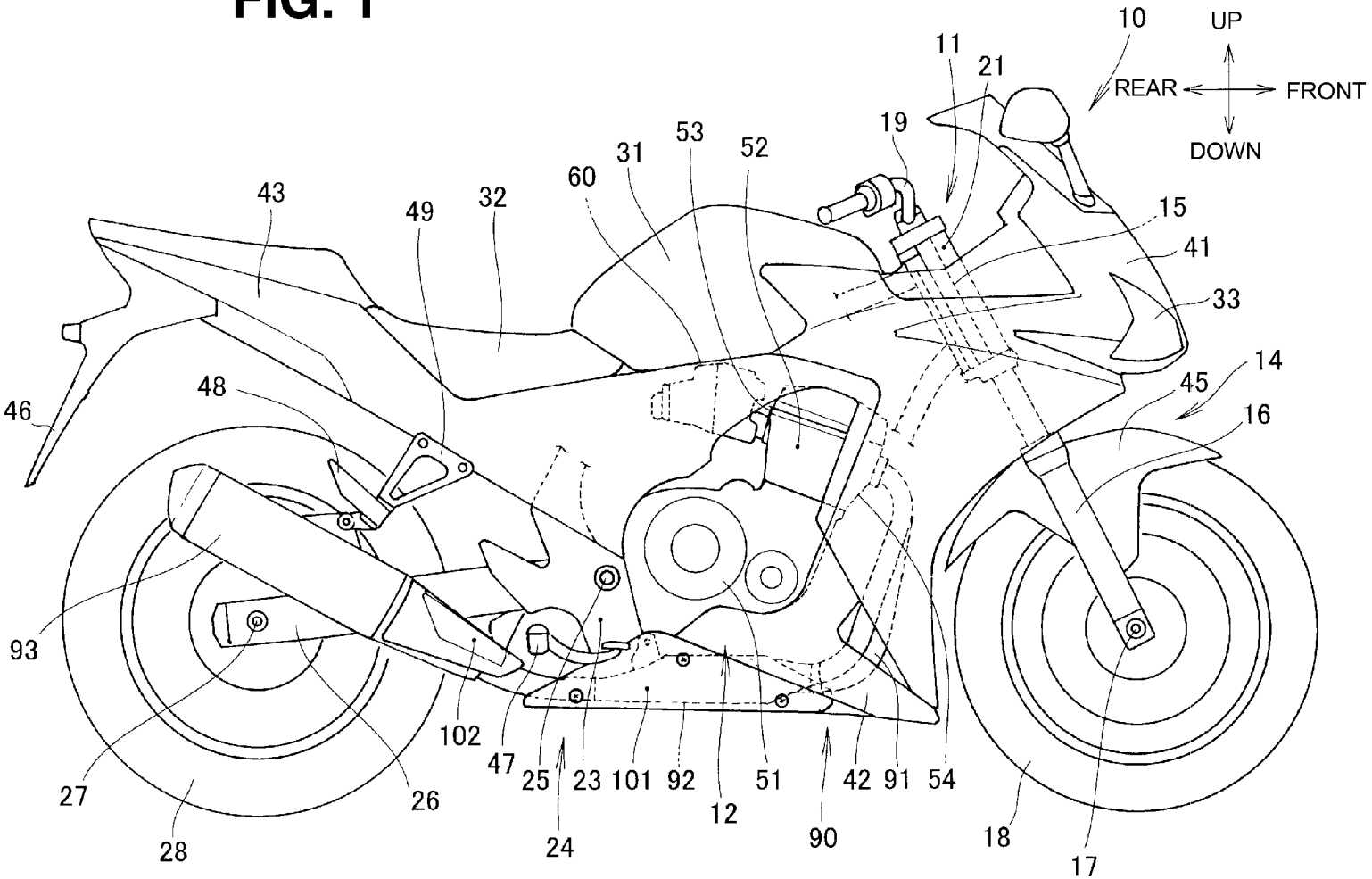
FIG. 1 is a right side view of a motorcycle according to the present invention.

As shown in FIG. 1, a motorcycle 10 includes, as main elements thereof, a vehicle body frame 11, an engine 12 as an internal combustion engine suspended from the vehicle body frame 11, a front wheel steering section 14 rotatably mounted to a head pipe 21 at the front end of the vehicle body frame 11, a rear wheel suspension section 24 mounted to a pivot frame 23 of the vehicle body frame 11, a fuel tank 31 disposed on the vehicle body frame 11 above the engine 12, and a seat 32 disposed behind the fuel tank 31 on the vehicle body frame 11 and configured to sit by an occupant.

The front wheel steering section 14 includes a steering shaft 15, a steering handlebar 19 fitted atop the steering shaft 15, a front fork 16 extending downward from the steering shaft 15, a front wheel shaft 17 connected to a lower end of the front fork 16 in a width direction of a vehicle, and a front wheel 18 rotatably fitted to the front wheel shaft 17.

The rear wheel suspension section 24 includes a pivot shaft 25 connected to the pivot frame 23 of the vehicle body frame 11 in the width direction of the vehicle, a swing arm 26 extending from the pivot shaft 25 to the rear side of the vehicle, a rear wheel shaft 27 connected to a rear end of the swing arm 26, a rear wheel 28 fitted to the rear wheel shaft 27, and a cushion unit not shown connected between the swing arm 26 and the vehicle body frame 11.

Next, a vehicle body cover and the like will be described.

A front portion of the vehicle body frame 11 is covered with a front cowl 41, a section extending from the bottom of the fuel tank 31 to the bottom of the engine 12 and a lower front part of the seat 32 are covered with a resin middle cowl 42, and in continuity with the middle cowl 42, a lower rear part of the seat 32 is covered with a rear cowl 43. A head light 33 is mounted at a front end of the front cowl 41. A front fender 45 for mud guarding of the front wheel 18 is fitted to the front fork 16 above the front wheel 18, and a rear fender 46 is fitted to a rear end of the vehicle body frame 11 for mud guarding of the rear wheel 28. Rider steps 47, 47 (only front side step 47 is shown) on which the feet of the rider are placed are fitted to the vehicle body frame 11, and pillion passenger steps 48, 48 (only front side step 48 is shown) on which the feet of a pillion passenger out of occupants are placed are fitted to the vehicle body frame 11 at the back of the rider steps 47, 47 via pillion passenger stays 49, 49 (only front side stay 49 is shown).

The engine 12 is a four-cycle two-cylinder engine wherein a crankshaft extends in the width direction of the vehicle. The engine 12 includes a crankcase 51, and a cylinder section 52 extending from the crankcase 51 diagonally upward in the front direction of the vehicle. An intake air routing device 60 is fitted to a rear wall 53 of the cylinder section 52, and an exhaust pipe 91 of an exhaust device is connected to a front wall 54 of the cylinder section 52.

The exhaust device 90 includes two exhaust pipes 91 extending from the engine 12, a catalyst chamber 92 standing between the two exhaust pipes 91 and configured to purify exhaust gas, and a muffler 93 connected to a rear end of the exhaust pipe 91. The muffler 93 is fitted to a pillion passenger step stay 49 on the right side. The catalyst chamber 92 is covered with a metallic protective member 101. Further, a front part of the muffler 93 is covered with a metallic decorative cover 102.

Figure 2:
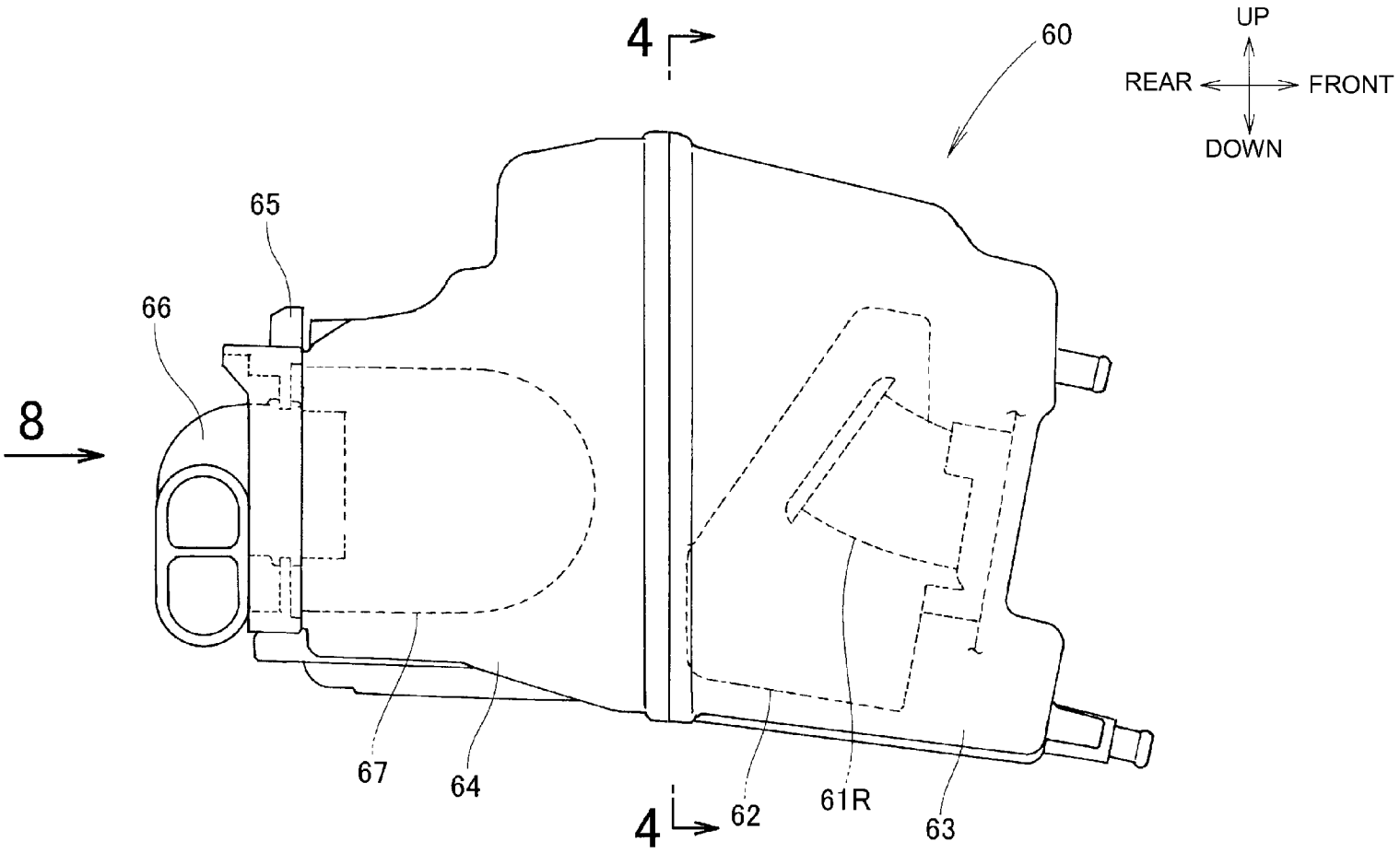
FIG. 2 is a side view of an intake air routing device supplying intake air into an internal combustion engine.

As shown in FIG. 2, the intake air routing device 60 is fitted to the engine 12 (FIG. 1), and includes left and right funnel members 61L, 61R (only front side funnel member 61R is shown) forming an entrance of the intake passage, a partition plate (partition wall) 62 partitioning the left and right funnel members 61L, 61R from each other, a front half case body 63 enclosing the circumference of the funnel members 61L, 61R, a rear half case body 64 fitted to the front half case body 63 from the rear side of the vehicle, an end cap 65 fitted to a rear end of the rear half case body 64 in a removable manner, an intake duct 66 provided on the vehicle rear side of the end cap 65 and configured to take in outside air, and a filter element (e.g., air filter) 67 provided on the vehicle front side of the end cap 65 and configured to filter the outside air taken in through the intake duct 66. The front half case body 63 and the rear half case body 64 collectively form a case body 60A (FIG. 2).

Figure 3:
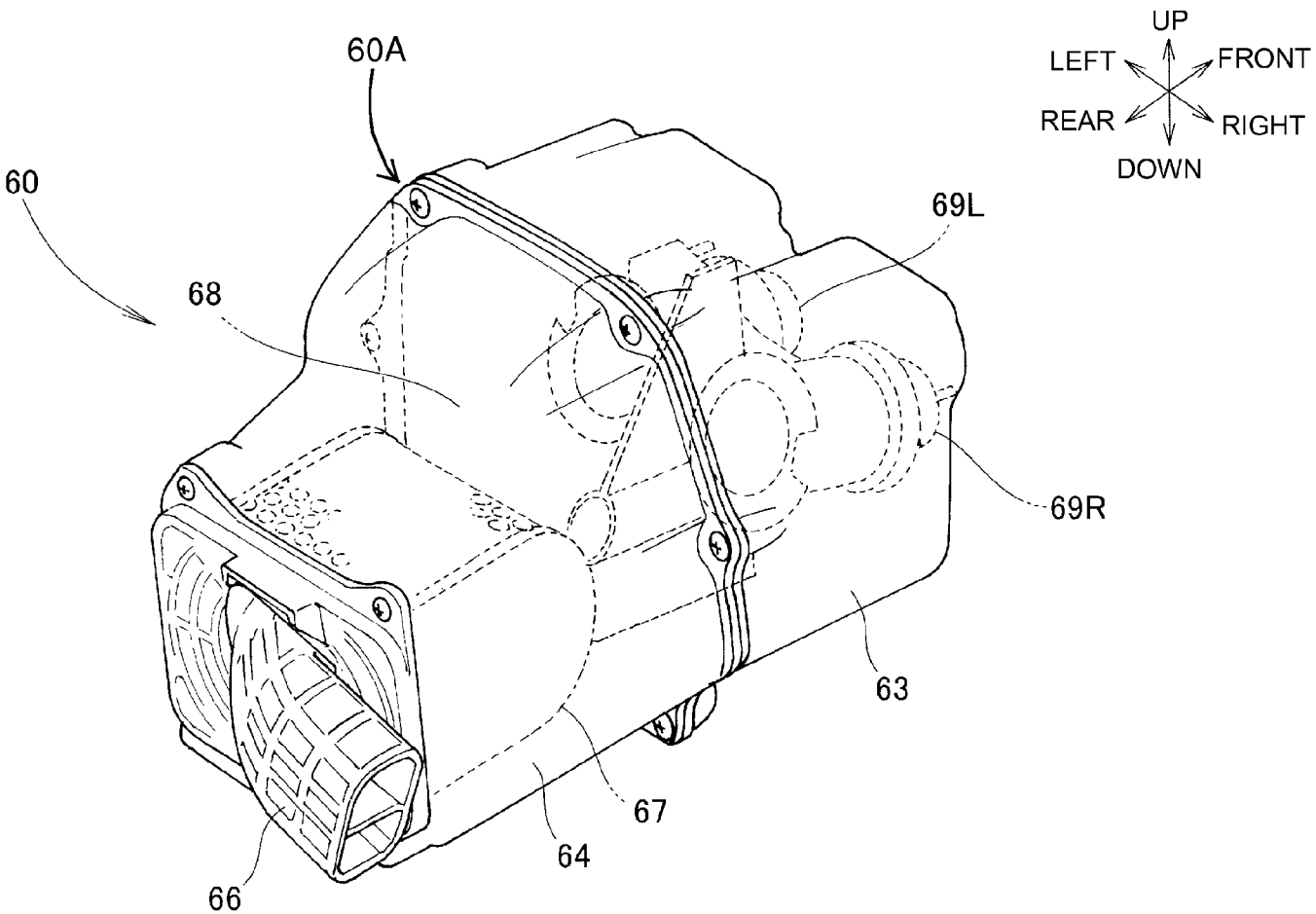
FIG. 3 is a perspective view of the intake air routing device.

As shown in FIG. 3, the intake air routing device 60 includes the intake duct 66 configured to take in the outside air, the front half case body 63, the rear half case body 64, an air chamber 68 formed by bringing the front half case body 63 and the rear half case body 64 into contact with each other, and left and right intake passages 69L, 69R extending from the air chamber 68.

The air filter element 67 is configured to clean and filter incoming air, and is situated in the air chamber 68 just in front of the intake duct 66.

In the manner described above, the intake air routing device 60 is configured by assembling a number of component parts. Details of the assembly structure will be described below.

Next, with the front half case body opened, the structure and configuration of the front half case body will be described, including left and right funnel members forming intake passages and serving as intake ports (communication ports) of the engine, and a partition plate disposed between the left and right funnel members, and the like.

Figure 4:
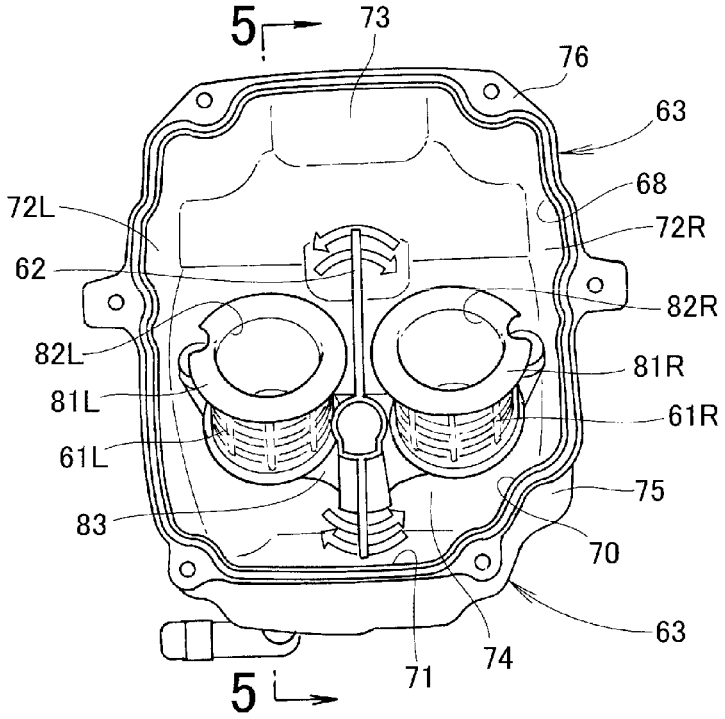
FIG. 4 is a view taken along arrow 4-4 of FIG. 2.

As shown in FIG. 4, the front half case body 63 has a floor section 71, left and right walls 72L, 72R each rising from left and right ends of the floor section 71, a ceiling section 73 connected between the left and right walls 72L, 72R, and a vertical front wall 74 connected to the vehicle front side of the floor section 71, the left and right walls 72L, 72R and the ceiling section 73. The inner surface 70 of the front half case body 63 forms a front half portion of the air chamber 68. A flange section 76 is formed at a front edge portion of the front half case body 63 between the inner surface 70 and an outer surface 75 thereof, and the flange section 76 serves as a joint portion where the rear half case body 64 (FIG. 3) is fastened.

Disposed on the vertical front wall 74 forming the air chamber 68 is the partition wall (partition plate) 62 including a member different from a member of the air chamber 68 and partitioning the upstream ends 81L, 81R of the left and right funnel members 61L, 61R from each other. In other words, the partition plate 62 is formed separately from the case body 60A. The partition plate 62 enters into the air chamber 68 by a predetermined length from the vehicle rear side to the front side in a direction intersecting with a direction where the left and right funnel members 61L, 61R forming the intake passages are lined up. The partition plate 62 is formed integrally with a base member 83, provided for supporting the left and right funnel members 61L, 61R. Formed at each of the upstream ends 81L, 81R of the left and right funnel members 61L, 61R are communication ports 82L, 82R. The partition plate 62 is disposed between the communication ports 82L, 82R of the intake passages.

In the present embodiment, an intake air routing device for a two-cylinder engine includes the partition wall 62 disposed between the upstream ends of the left and right intake passages. In a similar manner, additional partition wall(s) may be disposed each among the upstream ends of the intake passages of an internal combustion engine having a plurality of cylinders, for example, by disposing the partition wall each among the upstream ends of the intake passages of three-cylinder, four-cylinder, five-cylinder or six-cylinder engine.

Figure 5:
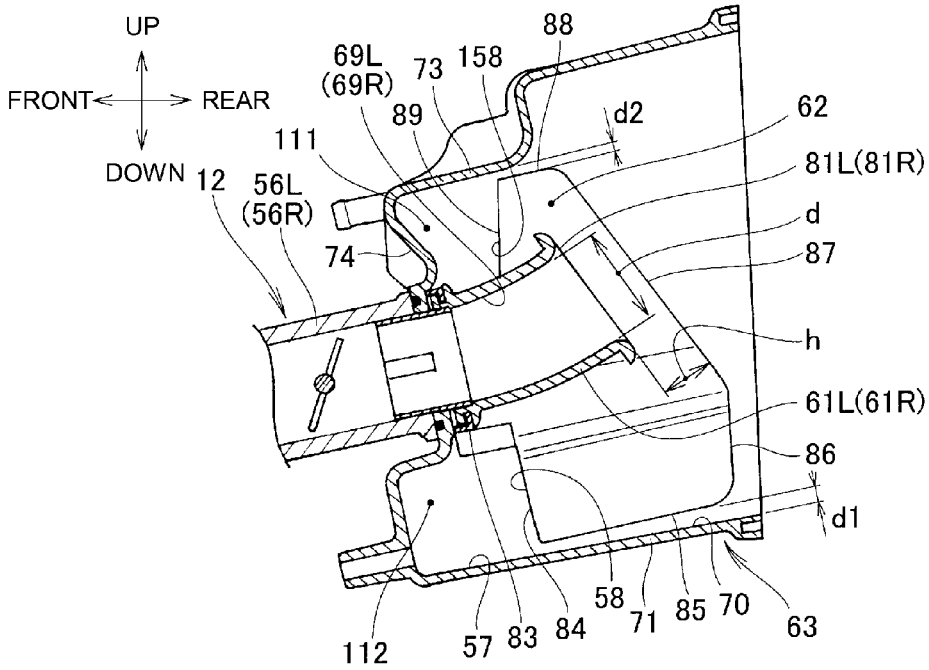
FIG. 5 is a cross-sectional view taken from line 5-5 of FIG. 4.

As shown in FIG. 5, the funnel member 61L forming the intake passage 69L is connected to a throttle body intake port 56L of an internal combustion engine (engine 12) for routing air into the intake port 56L. The intake passage (funnel member 61L) is inserted into the vertical front wall 74 of the air chamber. In FIG. 5, description of the intake passage 69R provided on the reverse side of the drawing of the intake passage 69L is omitted since the structure thereof is same as the intake passage 69L.

The funnel members 61L, 61R curve diagonally upwardly so that the farther apart from the vertical front wall 74, the higher the upstream ends 81L, 81R of the funnel members 61L, 61R are positioned. The partition wall 61 (partition plate 61) extends in such a manner as to expand in the axis direction of the intake passage from the downstream of the intake passage beyond the upstream ends 81L, 81R of the communication ports, as viewed from a direction where the intake passage 69L (intake passage 69R in FIG. 4) is lined up.

A partition plate 62 standing upright on the funnel member base (base member 83) has an outline section including a lower front side 84, a lower side 85 extending from the lower end of the lower front side 84 toward the vehicle rear side, a rear side 86 extending upward from a vehicle rear end of the lower side 85, a rear diagonal side 87 extending in substantially parallel with the upstream ends 81L, 81R of the intake passages from an upper end of the rear side 86, an upper side 88 extending from an upper end of the rear diagonal side 87 toward the rear side of the vehicle, and an upper front side 89 extending downward from a vehicle front end of the upper side 88.

The sides 84-89 defining a substantial portion of the perimeter edge of the partition 62 and which are spaced from the interior surface of the case body 63, 64.

Next, a configuration with the partition plate 62 formed with the first cutout section 58 and the lower communication section 112 formed by the first cutout section 58 will be described.

Referring to FIG. 4 together, the drain chamber 57 is provided below the vertical front wall 74 of the front half case body 63 for collecting moisture from the air chamber 68. The drain chamber 57 is provided with the first cutout section 58 where the partition plate 62 is cut out so as to prevent the partition wall 62 (partition plate 62) from intruding into the drain chamber 57. The first cutout section 58 is defined by the lower front side 84 and the vertical front wall 74 of the front half case body 63.

By providing the first cutout section 58 thus formed, the lower communication section 112 is formed between the first cutout section 58 and the floor section 71 of the air chamber 68 in the position near to the connection end with the funnel members 61L, 61R connected to the intake ports 56L, 56R of the internal combustion engine 12.

Next, a configuration with the partition plate 62 formed with the second cutout section 158 and the upper communication section 111 formed by the second cutout section 158 will be described.

The second cutout section 158 is provided to the partition wall 62 above the vertical front wall 74 of the front half case body 63. The second cutout section 158 is defined by the upper front side 89 and the vertical front wall 74 of the front half case body 63.

By providing the second cutout section 158 thus formed, the upper communication section 111 is formed between the second cutout section 158 and the ceiling section 73 of the air chamber 68 in the position near to the connection end with the funnel members 61L, 61R connected to the intake ports 56L, 56R of the internal combustion engine 12.

Next, a positional relationship between the upper side 88 of the partition plate 62 and the ceiling section 73 of the air chamber and a positional relationship between the lower side 85 of the partition plate and the floor section 71 of the air chamber will be described.

One end (upper side 88) of the partition wall 62 in a direction orthogonal to the extending direction of the partition plate 62 extends up to the vicinity of the ceiling section 73 of the air chamber, and another end (lower side 85) of the partition wall 62 extends down to the vicinity of the floor section 71 of the air chamber. That is, the first end (upper side 88) and second end (lower side 85) of the partition wall 62 extend up to the vicinity of the inner surface 70 of the air chamber 68.

Specifically, as shown in FIG. 5, the one end (upper side 88) of the partition wall 62 is arranged close to the inner surface 70 of the ceiling section 73 forming the air chamber 68 at a second predetermined interval (d2), and another end (lower side 85) of the partition wall 62 is arranged close to the inner surface 70 of the floor section 71 forming the air chamber 68 at a first predetermined interval (d1).

Next, a positional relationship between the rear diagonal side 87 of the partition plate 62 and the upstream ends 81L, 81R of the intake passages will be described.

The rear diagonal side 87 of the partition plate 62 extends up to a position beyond the upstream ends 81L, 81R of the intake passages. An expanded length "h" of the partition plate 62 is made larger than ½ of the inner diameter of each of the upstream ends of the intake passages from the upstream ends 81L, 81R of the intake passages ((d/2)<h).

In one exemplary embodiment, the inner diameter "d" of the intake passage is d=36.9 mm, the distance "h" from the communication ports 82L, 82R opened in the upstream ends 81L, 81R of the intake passages to the rear diagonal side 87 of the partition wall is h=20 mm, and a surface including the upstream ends 81L, 81R of the intake passages and the rear diagonal side 87 of the partition wall are in parallel with each other.

Functions of the above-described intake air routing device will be described below.

Figure 6A:
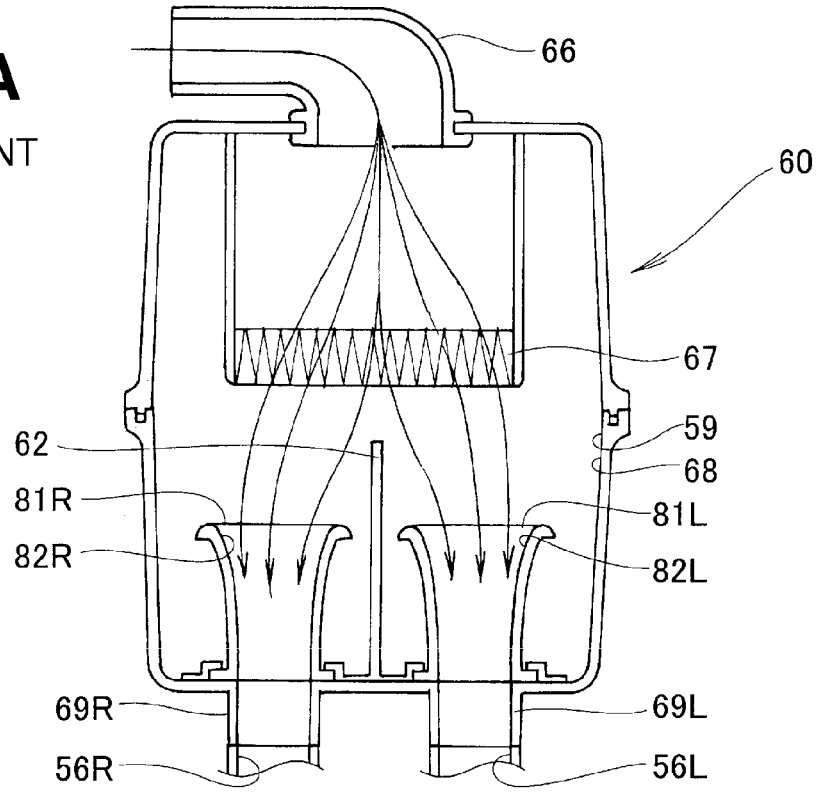
FIG. 6A is a diagram illustrating a structure and operation of the intake air routing device according to the embodiment of the present invention
Figure 6B:
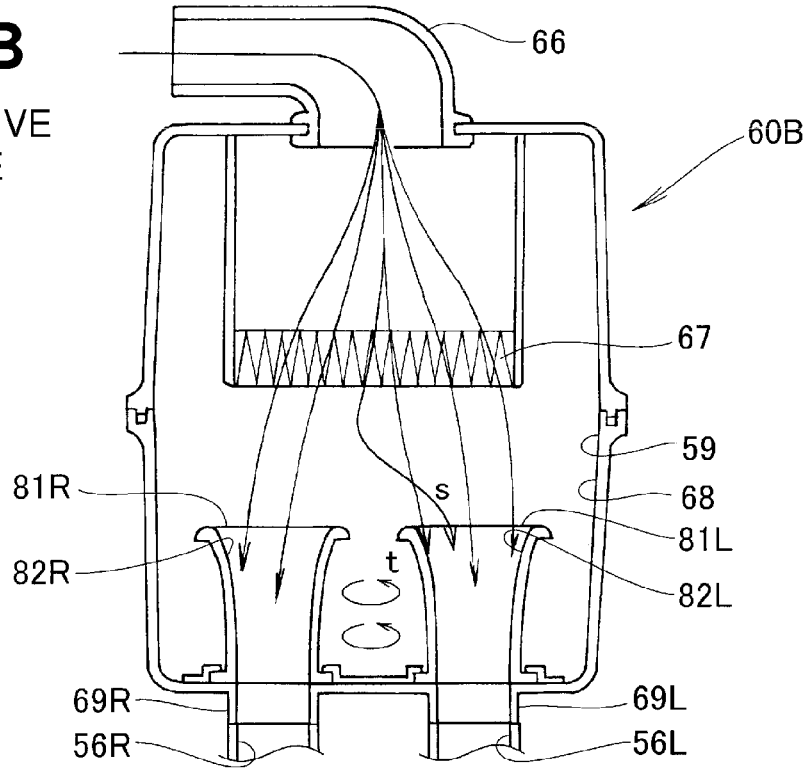
FIG. 6B is a diagram illustrating a structure and operation of an intake air routing device according to a comparative example.

FIG. 6A is a diagram illustrating a structure and operation of the intake air routing device according to the embodiment, and FIG. 6B is a diagram illustrating a structure and operation of an intake air routing device according to a comparative example.

As shown in FIG. 6A and FIG. 6B, the intake air routing device 60 (60B) is provided with two intake passages 69L, 69R whose downstream ends are connected to the intake ports 56L, 56R of the left and right cylinders of a two-cylinder engine 12, and the air chamber 68 inserting therein the left and right communication ports 82L, 82R opened to the upstream ends 81L, 81R of the intake passages 69L, 69R and defining the clean chamber 59 in cooperation with the air filter element 67.

As shown in FIG. 6B depicting the comparative example, the clean chamber 59 is not provided with a partition plate 62 partitioning the left and right intake passages 69L, 69R from each other, whereby there may occur a phenomenon (intake interference) wherein intake air flowing through different intake pipes influence each other due to a difference in the intake timing between the cylinders, between the intake pipes extending from respective cylinders. This may lead to the disturbance of the intake air flow. Specifically, as indicated by arrow "s" in drawing, in addition to the disturbance generated on the upstream side of the upstream ends 81L, 81R of the left and right funnel members 61L, 61R, as indicated by arrow "t" in drawing, there is the disturbance generated in the position near to the connection end with each intake port (56L, 56R) on the downstream side of the upstream ends 81L, 81R.

In this regard, the present invention provides, as shown in FIG. 6A the partition plate 62 disposed between the upstream ends 81L, 81R of the intake passages and extending in a direction intersecting with a direction wherein the intake passages 69L, 69R are lined up. Intake air entering into the air chamber 68 and purified through the air filter element 67 is partitioned by the partition wall 62 and reaches respective intake passages 69L, 69R. This partition plate 62 reduces the so-called intake interference wherein an intake air flowing through an intake passage 69L or 69R influences an intake air flowing through another intake passage 69L or 69R.

The partition plate 62 is entered into the air chamber 68 by a predetermined length so as to partition the upstream ends 81L, 81R of the intake passages from each other, whereby the intake interference can be reduced and the capacity increase of the air chamber 68 can be suppressed. Accordingly, the present invention provides an intake air routing device 60 capable of reducing the intake interference and suppressing the enlargement of the intake air routing device.

As shown in FIG. 5, the partition plate 62 extends up to a position beyond the upstream ends 81L, 81R of the intake passages. Since the partition plate 62 extends beyond the upstream ends 81L, 81R of the intake passages, occurrence of the intake interference wherein an air flowing through an intake passage 69L or 69R influences an air flowing through another intake passage 69L or 69R can be suppressed.

A length (h) of the partition plate 62 is made larger than ½ of the inner diameter (d) of the upstream ends 81L, 81R of the intake passages from the upstream ends 81L, 81R of the intake passages ((d/2)<h). Since the partition wall 62 extends beyond the upstream ends 81L, 81R of the intake passages, interference of intake air passing through neighboring intake passages 69L, 69R can be sufficiently suppressed by the partition plate 62. Consequently, the intake interference can be further reduced.

Further, one end (upper side 88) and another end (lower side 85) of the partition wall 62 extend up to the vicinity of the inner surface 70 of the air chamber 68. The upper side 88 and the lower side 85 of the partition wall extending up to the vicinity of the inner surface 70 of the air chamber 68 prevent intake air from flowing into a neighboring cylinder intake passage by bypassing around an upstream end 81L or 81R of an intake passage and thereby reduce intake interference by such a bypassing air.

Further, the one end (upper side 88) and another end (lower side 85) of the partition wall are respectively arranged close to the ceiling section 73 forming the air chamber and the inner surface 70 of the floor section 71 at the predetermined intervals. The intake air is moved to another intake passage through the clearance (second predetermined interval) (d2) between the partition wall 62 and the ceiling section 73 and the clearance (first predetermined interval) (d1) between the partition wall 62 and the floor section 71. Generation of the turbulence of the airflow between the intake passages is suppressed by the clearances, and also the intake air can be distributed to the respective intake passages 69L, 69R in the balanced manner. As a result, output characteristics of an engine 12 (FIG. 1) are balanced.

Furthermore, the lower communication section 112 is formed between the first cutout section 58 provided at another end (lower side 85) of the partition wall 62 and the floor section 71 of the air chamber 68. The second cutout section 158 is provided to the partition wall 62 above the vertical front wall 74, and the upper communication section 111 is formed between the second cutout section 158 and the ceiling section 73 of the air chamber 68 in the position near to the connection end with the funnel members 61L, 61R. The intake air is moved to another intake passage through the upper and lower communication sections 111, 112. Generation of the turbulence of the airflow between the intake passages is suppressed by the upper and lower communication sections 111, 112, and also the intake air is distributed into the respective intake passages in the more balanced manner.

With this arrangement, although the intake system (air cleaner box 60) is compact, throbbing peculiar to a two-cylinder engine can be brought out, and further even stressless engine characteristics can be achieved.

Hereinafter, the structure (assembly structure) of the above-described intake air routing device will be described in detail.

Figure 7:
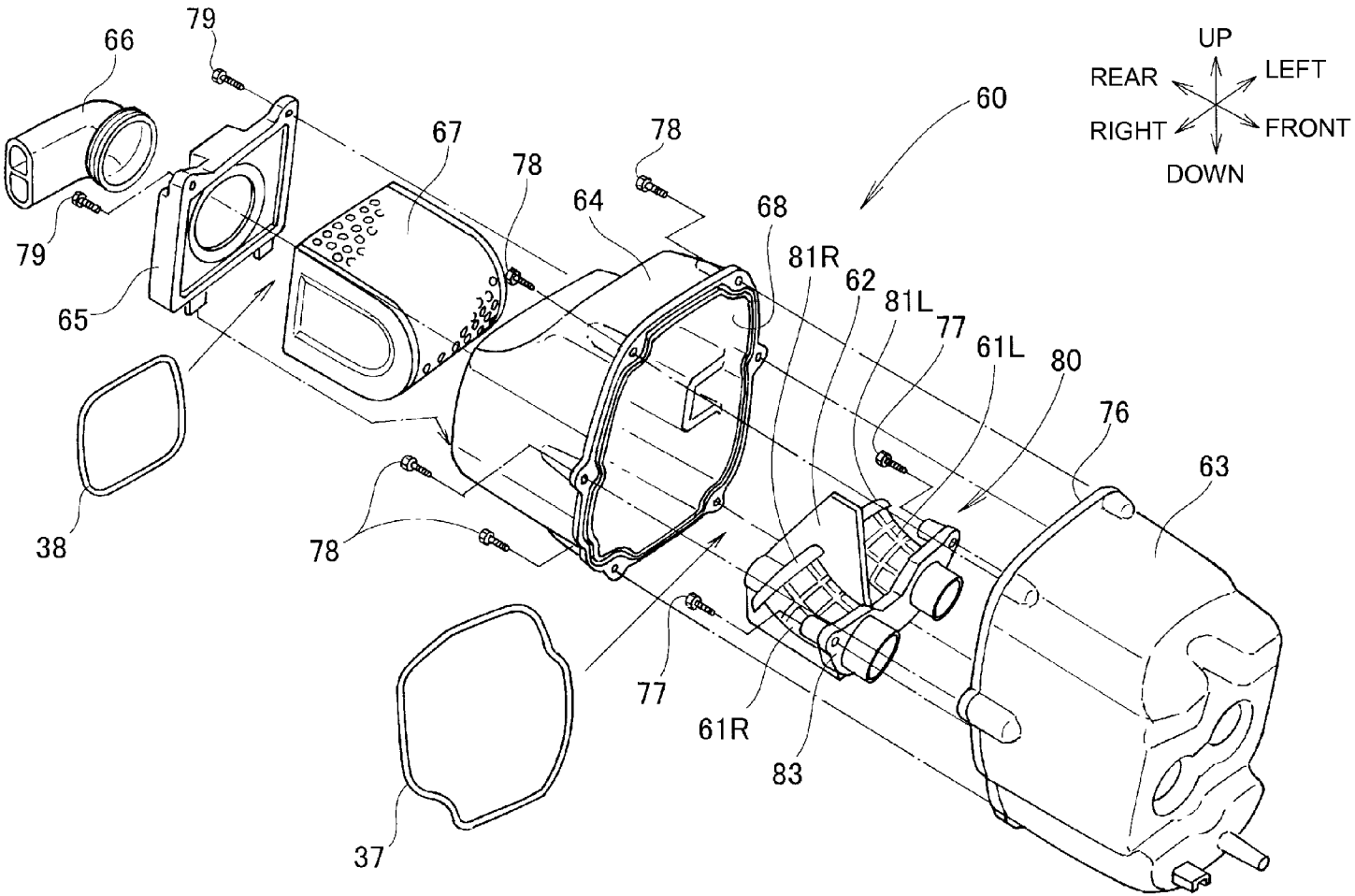
FIG. 7 is an exploded perspective view of the intake air routing device.

As shown in FIG. 7, the funnel member assembly 80 is attached to the front half case body 63 with a plurality of funnel member screws 77, the rear half case body 64 is fastened to the flange section 76 of the front half case body 63 with case screws 78, and an end cap 65 integrally formed by an intake duct 66 and the air filter element 67 is fastened to the rear half case body 64 with two screws 79. Here, the funnel member assembly 80 includes a base member 83 and funnel members 61L, 61R. Further, a first seal 37 is interposed between the front half case body 63 and the rear half case body 64, and a second seal 38 is interposed between the rear half case body 64 and the end cap 65.

The partition plate 62 is formed integrally with the base member 83 configured to attach the upstream ends 81L, 81R of the intake passages to the inner surface of the air chamber 68. Since the partition plate 62 is integrally formed on the base member 83 where the upstream ends 81L, 81R of the intake passages are mounted, the number of parts can be reduced more than a case where the partition plate 62 and base member 83 are mounted separately from each other.

Figure 8:
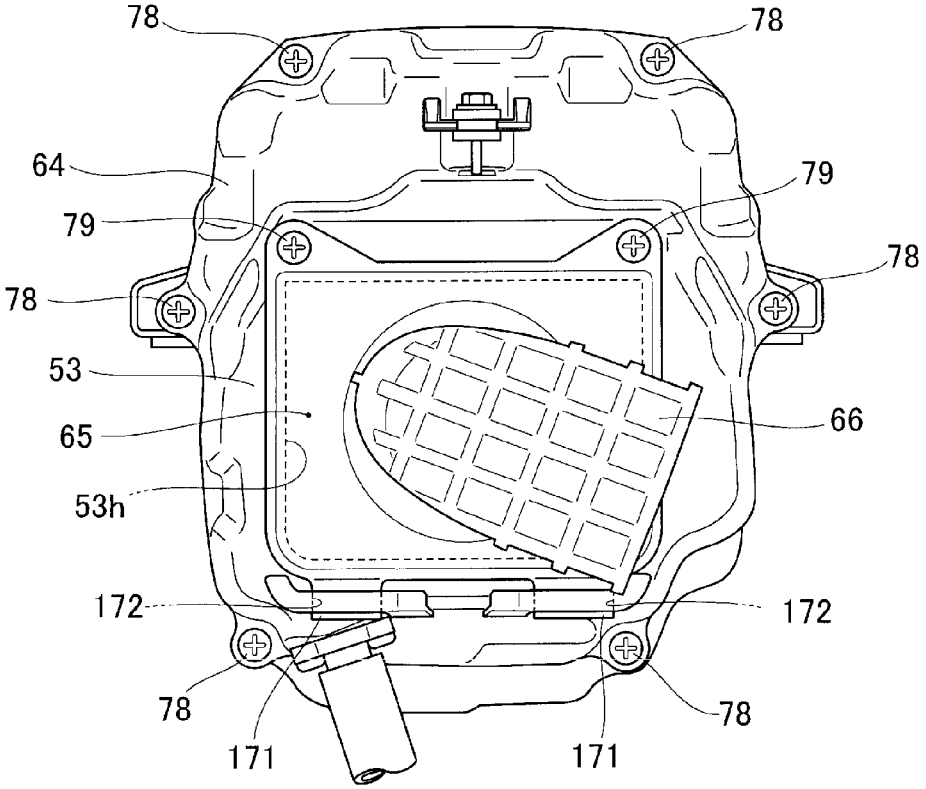
FIG. 8 is a view taken from arrow 8 of FIG. 2.

As shown in FIG. 8, a structure of the end cap 65 and peripheral portions thereof will be described.

The end cap 65 is configured to close an opening 53*h* opened through a rear wall 53 of the rear half case body 64, and is a member to which the intake duct 66 and the air filter (element) 67 (FIG. 7) are fitted. Projections 171, 171 extending downward project at a lower end of the end cap 65, and lock holes 172, 172 configured to lock the projections 171, 171 are opened through the rear half case body 64. To assemble the end cap 65 to the rear half case body 64, after the projections 171, 171 of the end cap are locked to the lock holes 172, 172 of the rear half case body 64, an upper end of the end cap 65 is fastened to a rear wall 53 of the rear half case body 64 with two screws 79.

Next, the funnel member assembly will be described.

Figure 9:
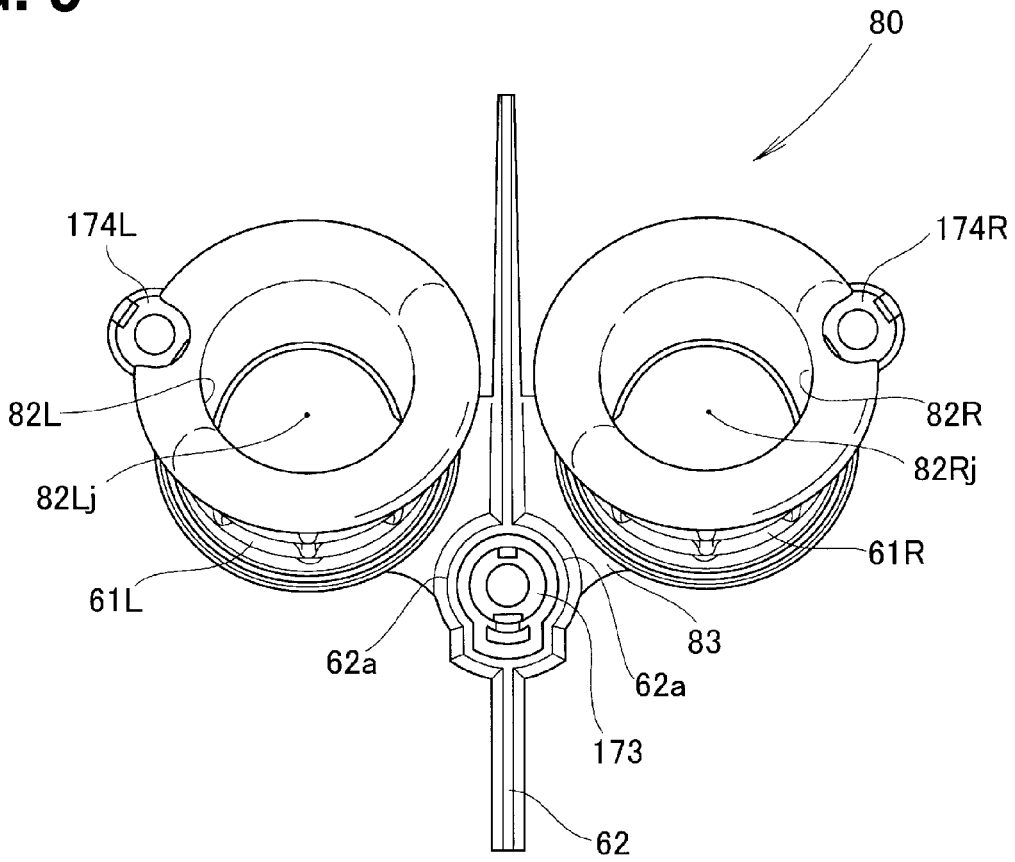
FIG. 9 is a perspective view of a funnel member assembly.

As shown in FIG. 9, the funnel member assembly 80 includes the base member 83 supporting the funnel members 61L, 61R, and the left and right funnel members 61L, 61R locked to the base member 83. The base member 83 includes the partition plate 62 which extends toward the viewer's side in the drawing so as to partition the left and right funnel members 61L, 61R from each other.

A central fastening boss section 173 configured to fasten the base member 83 to the front half case body (reference sign 63 in FIG. 7) forming the air chamber is formed integrally with the base member 83 on the partition plate 62 displaced from the intake axes 82Lj, 82Rj of the communication ports 82L, 82R. The bypass partition plate 62*a* is continuous so as to bypass around the central fastening boss section 173. The bypass partition plate 62*a* is a portion of the partition plate 62 expanding out around the central fastening boss section 173. In addition to the central fastening boss section 173, left and right fastening boss sections 174L, 174R are formed on the base member 83. The fastening structure in which the base member 83 is fastened to the front half case body 63 is as described above.

Next, an assembly procedure of the funnel member assembly will be described. Hereinafter, a procedure for assembling the left funnel member to the base member will be described. However, description of a right funnel member assembling procedure is omitted since it is same as the left funnel member assembling procedure.

Figure 10:
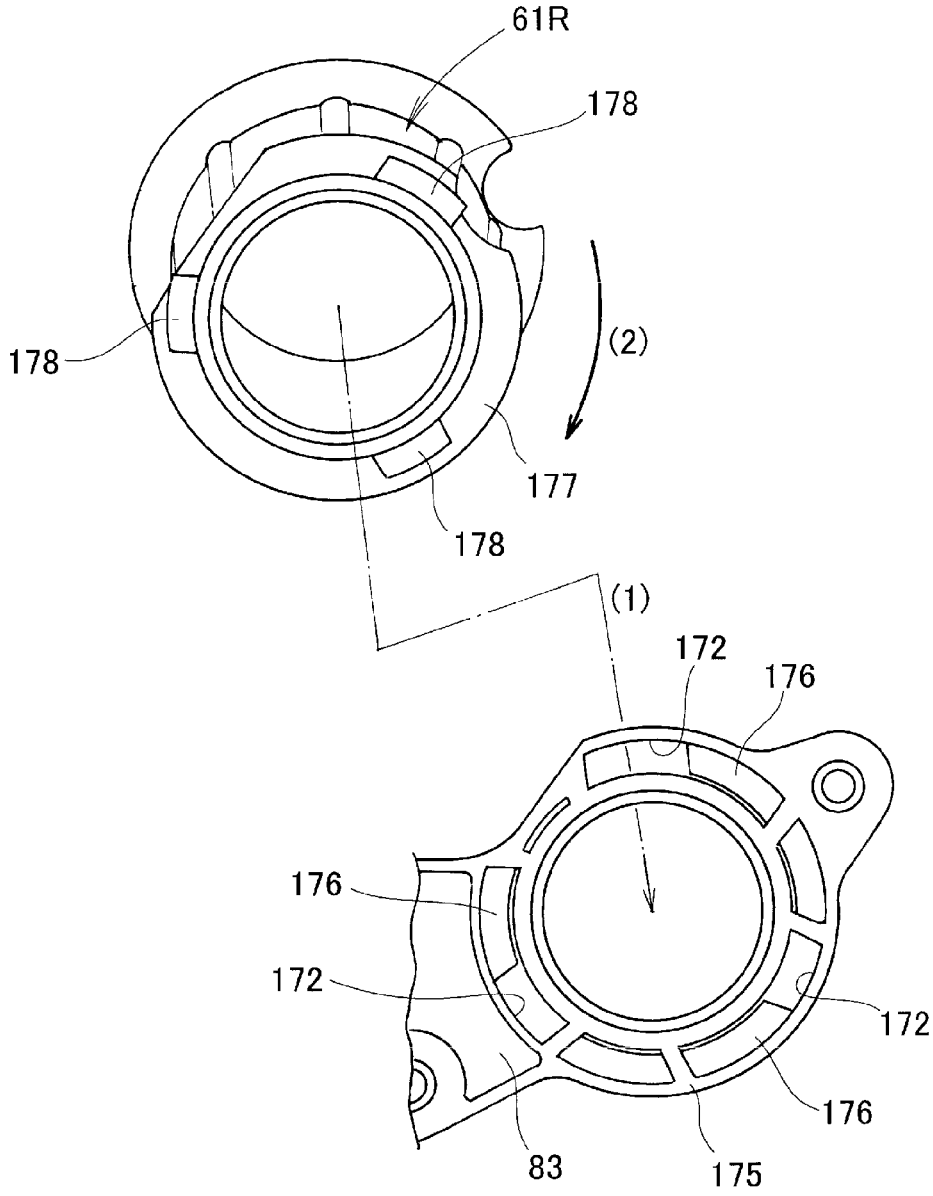
FIG. 10 is an operational illustration relative to the mounting shown in FIG. 8.

As shown in FIG. 10, three lock holes 172 are opened through a funnel member support 175 of the plate-like base member 83, and three locking sections 176 are formed on the three locking holes 172 continuously to lock the funnel member 61R when the funnel member 61R is rotated in a predetermined direction. Three claw sections 178 formed at the bottom 177 of the funnel member 61R and projecting in an outer peripheral direction are engaged with three locking sections 176.

As steps for assembling the funnel member 61R to the funnel member support 175, after the claw sections 178 of the funnel member 61R are set to the lock holes 172 of the base member 83 as shown in the direction of arrow (1), the funnel member 61R is turned in the direction of arrow (2) so as to overlap the claw sections 178 and locking sections 176 to each other and thereby mount the funnel member 61R to the funnel member support 175. The mounted funnel member 61R is shown in the next drawing.

Figure 11A:
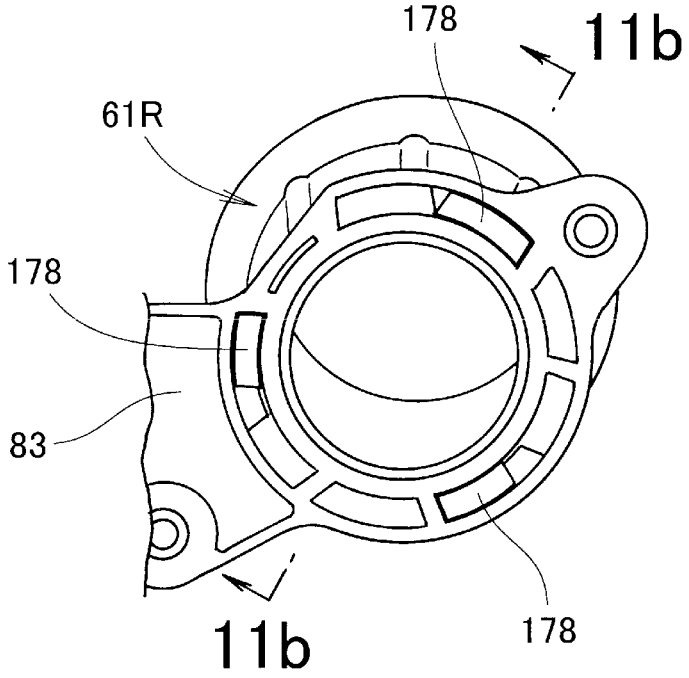
FIG. 11A shows the funnel member assembled into the base member shown in FIG. 10.
Figure 11B:
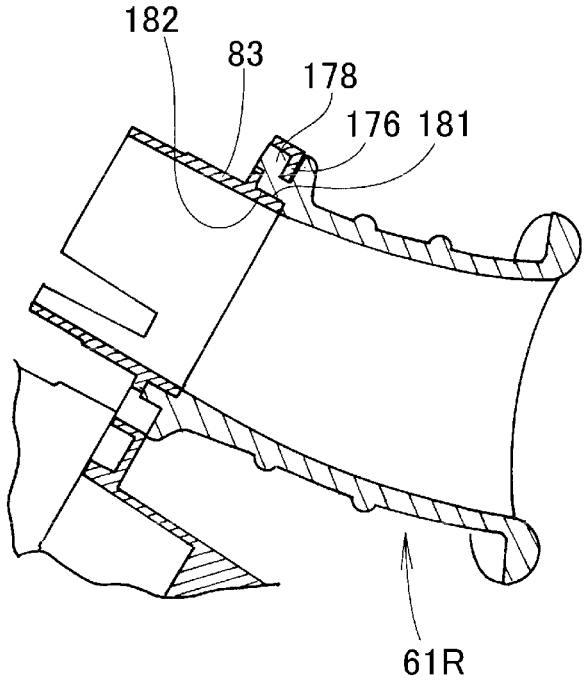
FIG. 11B is a cross-sectional view taken along arrow 11(*b*)-11(*b*) in FIG. 11A.

FIG. 11A shows the funnel member assembled into the base member shown in FIG. 10, and FIG. 11B is a cross-sectional view taken along arrow 11(*b*)-11(*b*) in FIG. 11A.

As shown in FIG. 11A and FIG. 11B, an inner peripheral section 182 of the funnel member 61R is fitted into an outer peripheral section 181 of the base member 83, and the claw sections 178 of the funnel member 61R are locked by the locking section 176 of the base member 83. In this way, the funnel member 61R is mounted to the base member 83 in a removable manner. Description of steps for assembling the funnel member 61L disposed on the opposite side is omitted since its structure is same as the funnel member 61R described above.

Next, a fastening structure of elements sub-assembled to the end cap, and the like will be described.

Figure 12:
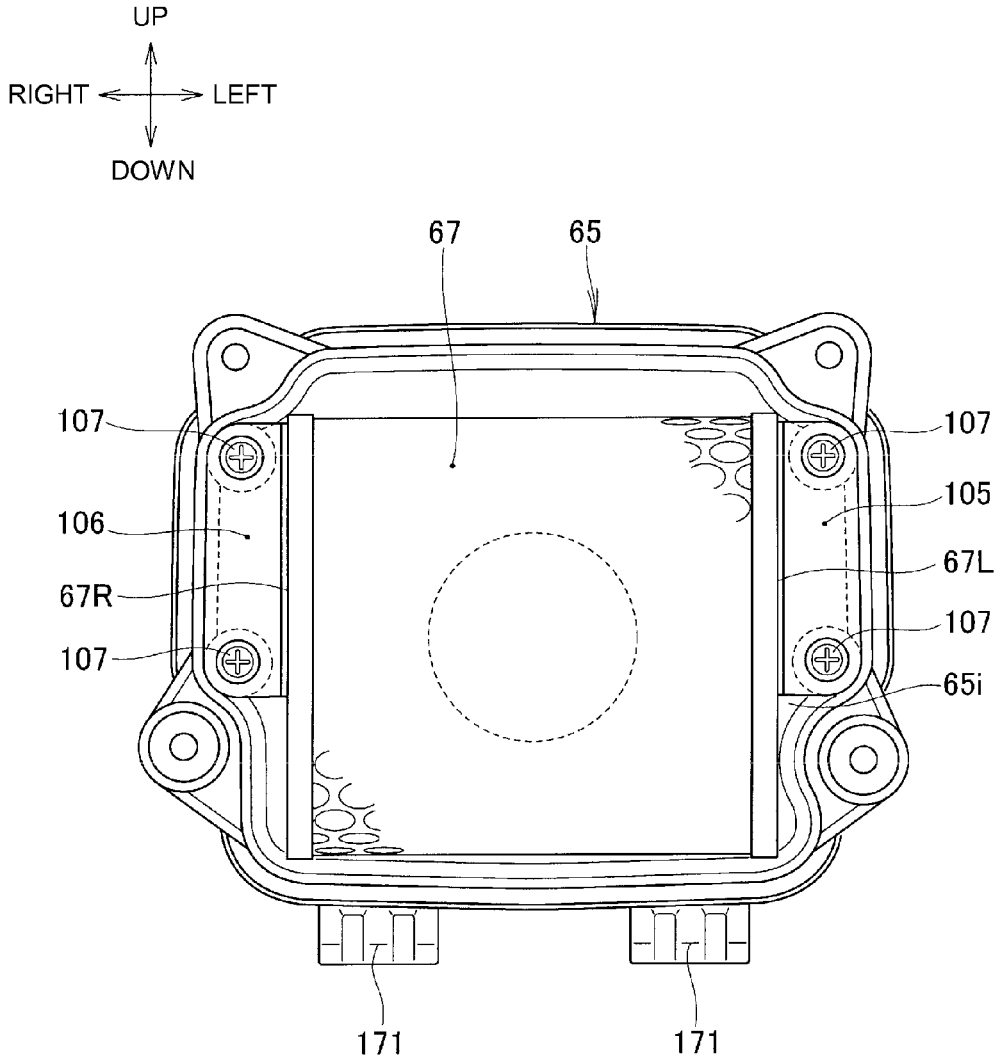
FIG. 12 is an elevation view for illustrating elements fastened to an end cap.

As shown in FIG. 12, L-shaped stays 105, 106 are fixed to left and right walls 67L, 67R of the air filter element 67. The stays 105, 106 are abutted on an inner wall 65*i* forming the inside of the end cap 65 and fastened to the end cap 65 with four element screws 107.

Figure 13:
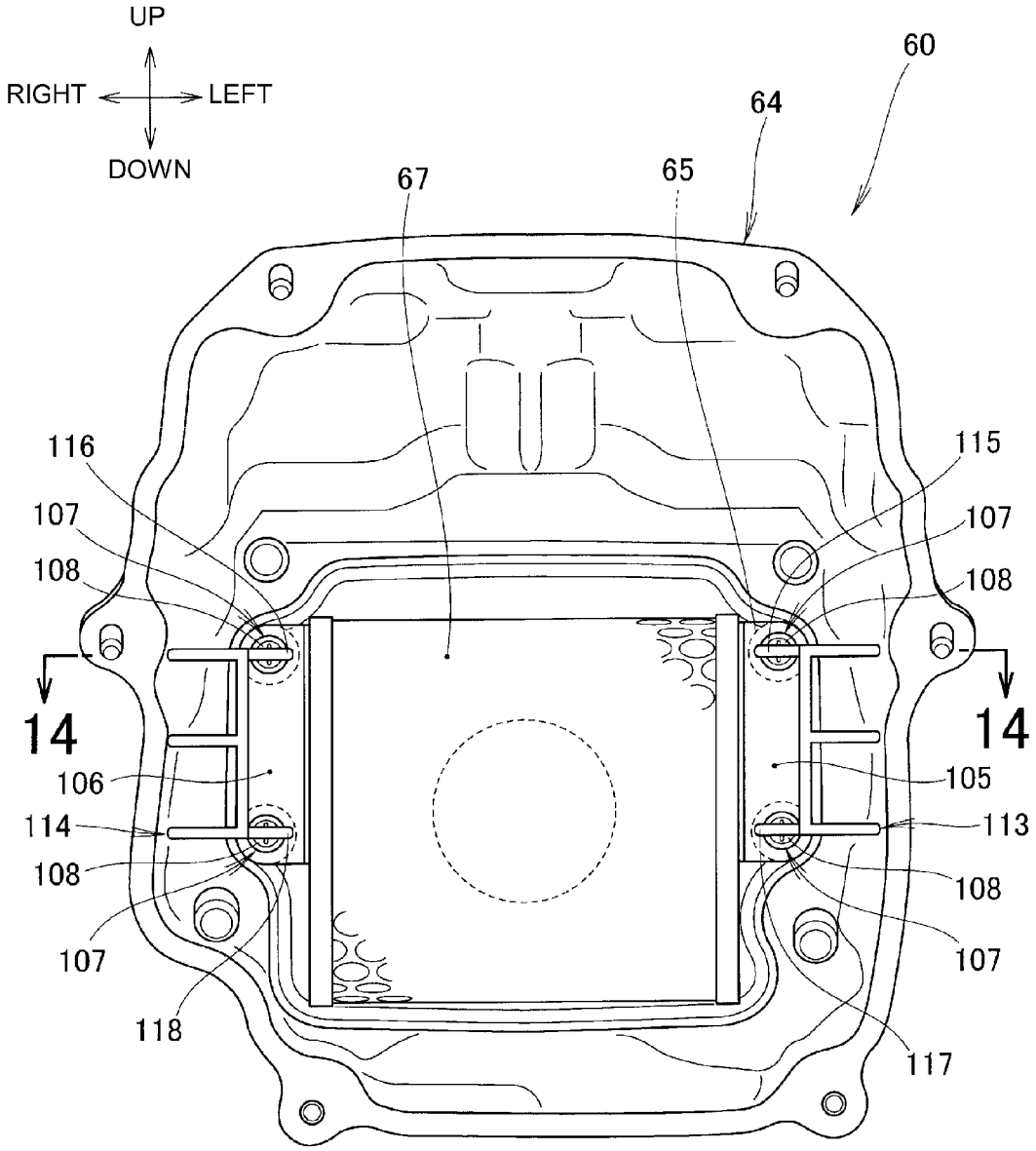
FIG. 13 is an elevation view of fastening portions of the elements viewed from a clean chamber with an air cleaner opened.

As shown in FIG. 13, the end cap 65 fitted with the air filter element 67 described with reference to FIG. 12 is inserted from a reverse side of the drawing to a front side of the drawing, that is, from the vehicle rear side into an opening of the rear half case body 64 for fitting thereto. When an opened intake air routing device 60 is viewed from the clean chamber side, four pressing sections 115 to 188 configured to prevent drop of four element screws 107 fastened to the end cap 65 are formed on the rear half case body 64 and arranged so as to close part of a head 108 of each of element screws 107.

Figure 14:
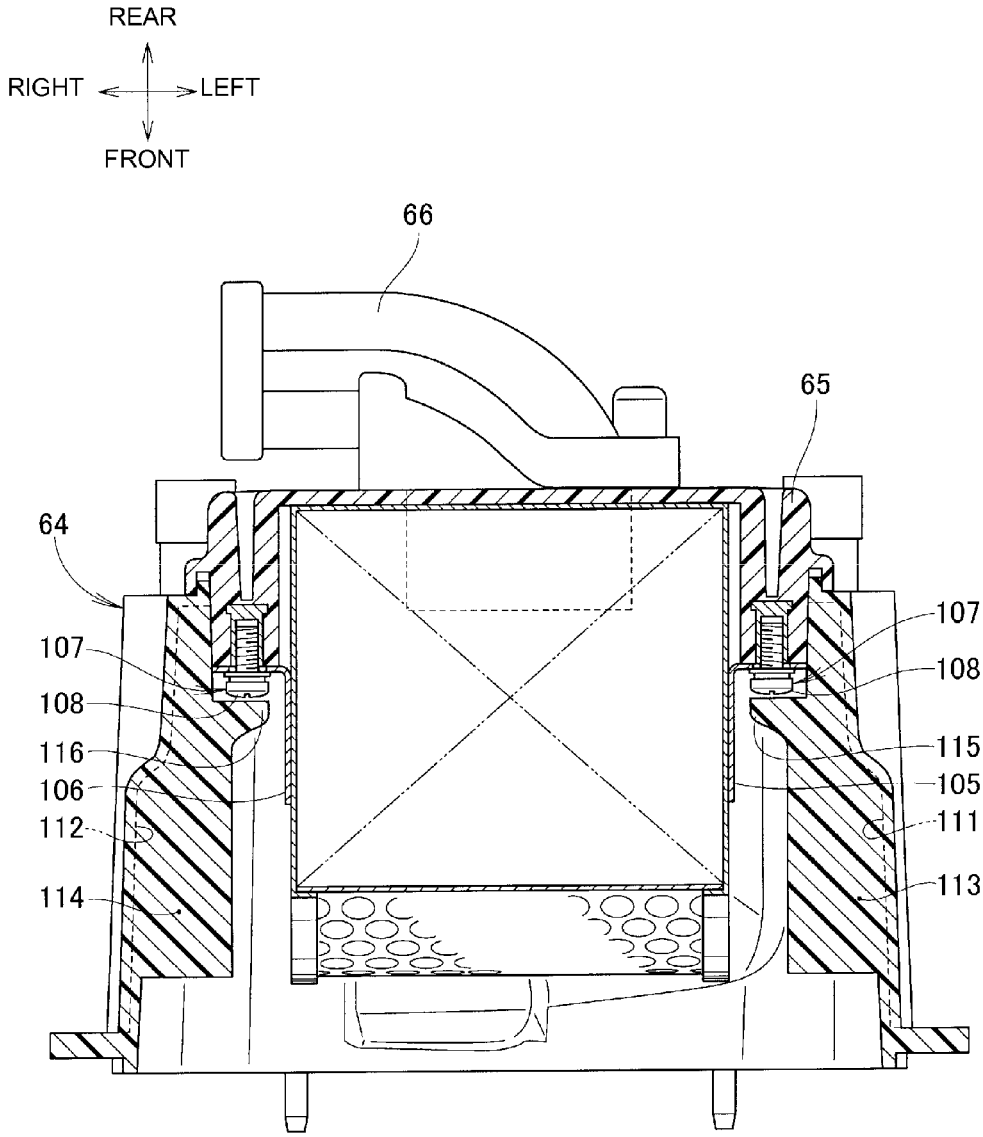
FIG. 14 is a cross-sectional view taken from line 14-14 of FIG. 13.

As shown in FIG. 13 and FIG. 14, the pressing sections 115 to 118 are portions where some of left and right libs 113, 114 extending from the left and right walls 111, 112 of the rear half case body 64 toward the vehicle front side are projected to the center in the vehicle width direction of the rear half case body 64. The pressing sections 115 to 118 are arranged each near the head 108 of the element screw so as to prevent drop of the element screw 107.

As shown in FIG. 12 through FIG. 14, after fastening the elements 67 to the end cap 65, the end cap 65 integrated with the elements 67 is fastened to the rear half case body 64. When performing maintenance of the air filter element 67, the element can be easily accessed just by removing the end cap 65 from the rear half case body 64. Consequently, maintainability of the air filter element 67 can be improved.

Further, the pressing sections 115 to 118 are formed on the rear half case body 64. The pressing sections 115 to 118 arranged on the vehicle front side of the heads 108 of the element screws prevent drop of the element screws 107 and enhance the retaining reliability of the air filter element 67.

Second Embodiment

Next, a second embodiment of the present invention will be described with reference to the accompanying drawings.

Figure 15:
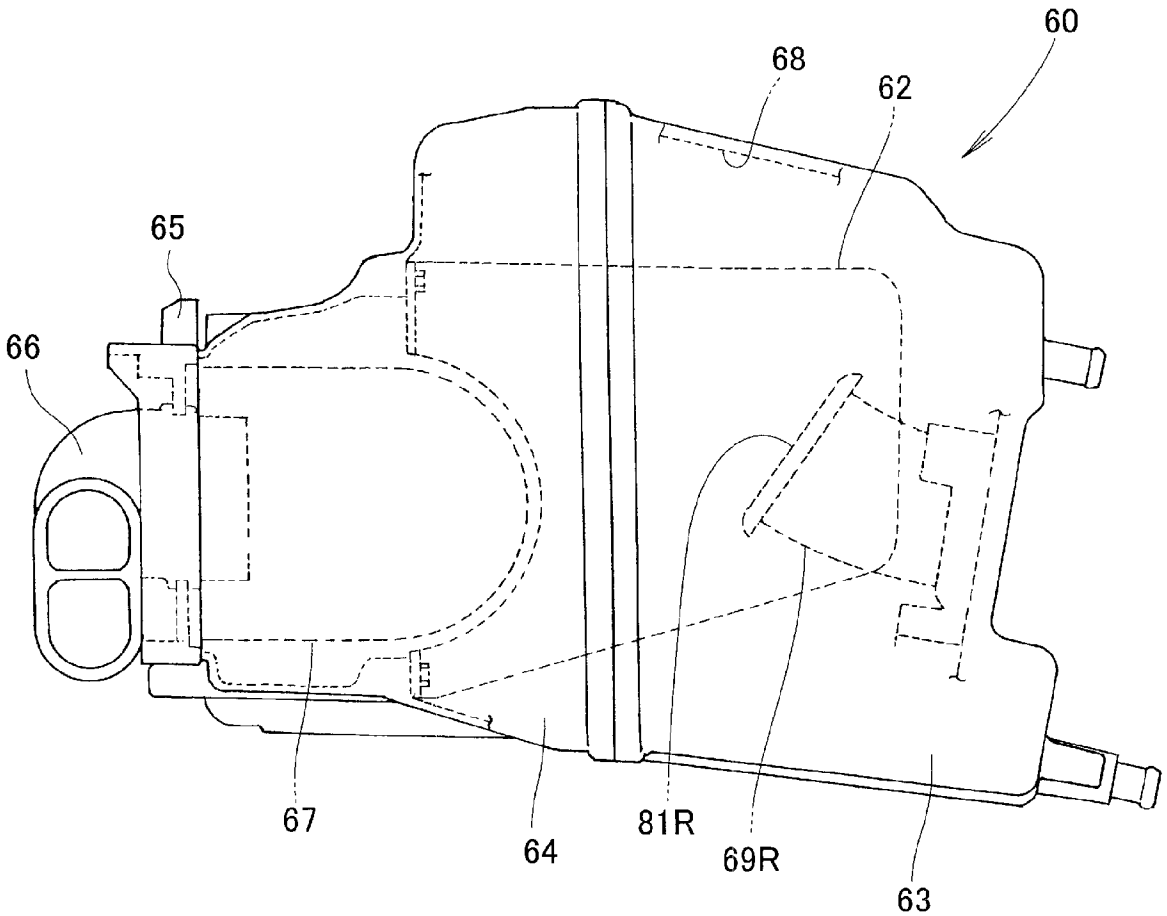
FIG. 15 shows another embodiment of FIG. 2.

As shown in FIG. 15, an intake air routing device 60 includes an air chamber 68, and two intake passages 69L, 69R (only an intake passage 69R on the front side is shown) extending from the air chamber 68, and is configured to route air into respective intake ports of an engine through the intake passages 69L, 69R. Disposed in the air chamber 68 is a partition plate 62 including a member different from a member of the air chamber 68 and entered into the air chamber 68 by a predetermined length in a direction intersecting with a direction where the intake passages 69L, 69R are lined up to partition upstream ends 81L, 81R (only front side upstream end 81R is shown) of the intake passages 69L, 69R from each other.

A significant difference from FIG. 2 is that the partition plate 62 extends from the side of the air filter element 67 to the side of intake passages. Other structures and functions are same, and therefore description thereof is omitted.

In the embodiment described above, the present invention is applied to a motorcycle, but it may be applied to a three-wheeled vehicle as well as an ordinary saddle-ride type vehicle.

INDUSTRIAL APPLICABILITY

The present invention is preferably applicable to a motorcycle including an engine having a plurality of cylinders.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An intake air routing device for an internal combustion engine, the engine comprising a plurality of cylinders and a plurality of intake ports, each of the intake ports operatively connected with a respective one of the cylinders; said intake air routing device operable to feed air into the intake ports of the internal combustion engine through a plurality of intake passages, said intake air routing device comprising:

a hollow case body having an air chamber formed therein and configured to take in outside air;

a plurality of intake passages at least partially disposed in the case body, wherein the intake passages are in fluid communication with the air chamber;

an air filter element disposed in the case body; and a partition wall formed separately from the case body and disposed in the air chamber so as to separate inlet portions of the intake passages from each other; wherein the partition has a perimeter edge and a substantial portion of the edge is spaced from an interior surface of the case body.

2. The intake air routing device of claim 1, wherein the partition wall extends in the air chamber by a predetermined length in a direction intersecting a direction where the intake passages are lined up.

3. The intake air routing device according to claim 2, wherein first and second ends of the partition wall in a direction orthogonal to an extending direction of the partition wall extend up to the vicinity of an inner surface of the case body.

4. The intake air routing device according to claim 2, wherein upstream ends of the intake passages are defined by funnel members which are removable from the case body, and the partition wall is formed integrally with the funnel members and is fitted to an inner surface of the air chamber.

5. The intake air routing device according to claim 2, wherein:

the intake passages are inserted into a vertical wall of the case body;

a drain chamber is formed below the vertical wall for collecting drain in the air chamber;

a first cutout section where the partition wall is cut out is provided to prevent the partition wall from intruding into the drain chamber, and the upstream ends of the intake passages are bent diagonally upward so that the farther apart from the vertical wall, the higher the upstream ends are positioned.

6. The intake air routing device according to claim 1, wherein the partition wall extends up to a position beyond the upstream ends of the intake passages.

7. The intake air routing device according to claim 6, wherein an extending length of the partition wall beyond the upstream ends of the intake passages is greater than one-half of the inner diameter of an upstream end of one of the intake passages.

8. The intake air routing device according to claim 7, wherein said first end of the partition wall is arranged close to one of an inner surface of a ceiling section and a floor section of the case body forming the air chamber at a first predetermined interval, and wherein said second end of the partition wall is arranged close to one of the inner surface of the ceiling section and the floor section of the case forming the inner surface of the air chamber at a second predetermined interval.

9. The intake air routing device according to claim 6, wherein first and second ends of the partition wall in a direction orthogonal to an extending direction of the partition wall extend up to the vicinity of an inner surface of the case body.

10. The intake air routing device according to claim 6, wherein:

the intake passages are inserted into a vertical wall of the case body;

a drain chamber is formed below the vertical wall for collecting drain in the air chamber;

a first cutout section where the partition wall is cut out is provided to prevent the partition wall from intruding into the drain chamber, and the upstream ends of the intake passages are bent diagonally upward so that the farther apart from the vertical wall, the higher the upstream ends are positioned.

11. The intake air routing device according to claim 10, wherein:

a second cutout section is provided to the partition wall above the vertical wall, and an upper communication section is formed between the second cutout section and the ceiling section of the air chamber in a position near to a connection end with a funnel member connected to an intake port of the internal combustion engine, and a lower communication section is formed between the first cutout section and the floor section of the air chamber in the position near to the connection end with the funnel member connected to the intake port of the internal combustion engine.

12. The intake air routing device according to claim 1, wherein upstream ends of the intake passages are defined by funnel members which are removable from the case body, and the partition wall is formed integrally with the funnel members and is fitted to an inner surface of the air chamber.

13. The intake air routing device according to claim 12, further comprising a base member; and wherein the partition wall is integrally formed on said base member which is configured to fit the upstream ends of the intake passages into an inner surface of the case body.

14. The intake air routing device according to claim 13, further comprising a fastening boss section integrally formed on the base member by the partition wall displaced from intake axes of the intake passages for fastening the base member to the case body, and wherein the partition wall is continuous so as to extend around the fastening boss section.

15. An intake air routing device for an internal combustion engine, said intake air routing device comprising:

a hollow case body having an air chamber formed therein;

an air filter element disposed in the case body;

an intake duct disposed on first end of the case body and connected to the air chamber via said air filter element;

a pair of funnel members each defining a portion of an intake passage and disposed at a second end of the case body, each intake passage being operatively connected to said engine; and a partition wall arranged between the intake passages and extending from the second end of the case body into the air chamber up to a position beyond upstream ends of said funnel members; wherein the partition has a perimeter edge and a substantial portion of the edge is spaced from an interior surface of the case body.

16. The intake air routing device according to claim 15, wherein a length of the partition wall at a position extending beyond the upstream ends of the intake passages is greater than one-half of the inner diameter of an upstream end of one of the intake passages.

17. The intake air routing device according to claim 15, wherein first and second ends of the partition wall in a direction orthogonal to an extending direction of the partition wall extend up to the vicinity of an inner surface of the case body.

18. An internal combustion engine, comprising a plurality of cylinders, each having an intake port;

a pair of funnel members, each defining a portion of an intake passage operatively connected with a respective one of said intake ports;

a case body having an air chamber formed therein; said air chamber configured to accommodate said pair of funnel members therein;

an intake duct disposed at an end portion of the case body and connected to the air chamber via an air filter arranged in the case body; and a partition plate arranged in said air chamber between the intake passages and extending in the air chamber up to a position beyond the upstream ends of the funnel members; wherein the partition has a perimeter edge and a substantial portion of the edge is spaced from an interior surface of the case body.

19. The internal combustion engine according to claim 18, wherein said partition plate is formed integrally with a base member; and wherein said base member is configured to support said funnel members thereon.

20. The internal combustion engine according to claim 18, wherein first and second ends of the partition plate in a direction orthogonal to an extending direction of the partition plate extend up to the vicinity of an inner surface of the case body such predetermined gaps are maintained between the first and second ends of the partition plate and the inner surfaces of the case body.

* * * * *